US010648682B2

(12) United States Patent
Van Der Lee

(10) Patent No.: US 10,648,682 B2
(45) Date of Patent: May 12, 2020

(54) BUILDING PROVIDED WITH AN AIR TREATMENT SYSTEM

(71) Applicant: DUTCH INNOVATION IN AIR TREATMENT BV, Meppel (NL)

(72) Inventor: Arthur Van Der Lee, Heerenveen (NL)

(73) Assignee: DUTCH INNOVATION IN AIR TREATMENT BV (NL)

( * ) Notice: Subject to any disclaimer, the term of this patent is extended or adjusted under 35 U.S.C. 154(b) by 224 days.

(21) Appl. No.: 15/737,421

(22) PCT Filed: Jun. 22, 2015

(86) PCT No.: PCT/EP2015/064011
§ 371 (c)(1),
(2) Date: Dec. 18, 2017

(87) PCT Pub. No.: WO2016/206714
PCT Pub. Date: Dec. 29, 2016

(65) Prior Publication Data
US 2018/0163982 A1 Jun. 14, 2018

(51) Int. Cl.
*F28C 1/00* (2006.01)
*F24F 5/00* (2006.01)
(Continued)

(52) U.S. Cl.
CPC ..... *F24F 5/0035* (2013.01); *F24F 1/0007* (2013.01); *F24F 3/044* (2013.01);
(Continued)

(58) Field of Classification Search
CPC ..... F24F 5/0035; F24F 1/0007; F24F 3/044; F24F 3/06; F24F 2003/144; F24F 6/02;
(Continued)

(56) References Cited

U.S. PATENT DOCUMENTS 2,715,515 A 8/1955 Stair
6,018,953 A 2/2000 Belding et al.
(Continued)

FOREIGN PATENT DOCUMENTS

FR 3002026 A1 8/2014
JP S5330763 U 3/1978
(Continued)

OTHER PUBLICATIONS

International Search Report for PCT/EP2015/064011; dated Mar. 3, 2016; 2 pgs.

*Primary Examiner* — Henry T Crenshaw
*Assistant Examiner* — Kamran Tavakoldavani
(74) *Attorney, Agent, or Firm* — Gardner Groff & Greenwald, PC

(57) ABSTRACT

The invention is directed to a building comprising more than one separate spaces and an air treatment system. The air treatment system comprises a central air drying unit fluidly connected to two or more local evaporative cooling units, wherein at least two local evaporative cooling units are each fluidly connected to a separate space of the building. The invention is also directed to a method to cool the air in two or more separate spaces by (a) drying ambient air in a central air drying unit to obtain a volume of dried air, (b) drawing in a part of the volume of dried air as obtained in step (a) to each separate space by means of an air displacement means and (c) using the dried air in a process of indirect evaporative cooling to obtain cooled air which is discharged into the interior of the separate space.

20 Claims, 5 Drawing Sheets

(51) Int. Cl.

| | |
|---|---|
| ***F24F 1/0007*** | (2019.01) |
| ***F24F 6/04*** | (2006.01) |
| ***F24F 3/06*** | (2006.01) |
| ***F24F 3/044*** | (2006.01) |
| *F24F 3/14* | (2006.01) |

(52) U.S. Cl.
CPC ..... *F24F 3/06* (2013.01); *F24F 6/043* (2013.01); *F24F 2003/144* (2013.01)

(58) Field of Classification Search
CPC .... F24F 6/04; F24F 6/043; F28D 5/00; F28D 5/02
See application file for complete search history.

(56) References Cited

U.S. PATENT DOCUMENTS

| | | | | |
|---|---|---|---|---|
| 2002/0073718 | A1 | 6/2002 | Maisotsenko et al. | |
| 2004/0226698 | A1 | 11/2004 | Reinders | |
| 2011/0302946 | A1 | 12/2011 | Gilbert | |
| 2013/0333408 | A1* | 12/2013 | Meijer ..... | F24F 6/02 62/314 |

FOREIGN PATENT DOCUMENTS

| | | | |
|---|---|---|---|
| JP | 2007315734 | A | 12/2007 |
| JP | 2010025377 | A | 2/2010 |
| WO | 9528609 | A1 | 10/1995 |
| WO | 2007024132 | A1 | 3/2007 |
| WO | 2011142672 | A1 | 11/2011 |
| WO | 2013021147 | A1 | 2/2013 |

* cited by examiner

BUILDING PROVIDED WITH AN AIR TREATMENT SYSTEM

The invention is directed to a building comprising more than one separate spaces and an air treatment system involving indirect evaporative cooling. The invention is also directed to a method to cool the air in two or more separate spaces involving indirect evaporative cooling.

Current air conditioning technology is based on compression and expansion of a gas such as chlorinated fluorocarbon or halogenated chlorofluorocarbon or ammonia. The gas is compressed to a liquid state and then allowed to expand back to a vapour state. In the expansion stage of the process, heat is required to change the liquid back to a gas. Vapour compression systems are disadvantageous in that they require the use of fluids which are not environmentally friendly and in that the system requires electricity to drive the compressors and thereby consumes a relatively large amount of energy.

Indirect evaporative cooling technology provides an alternative to vapour compression technology. In indirect evaporative cooling a primary air stream is cooled in a dry duct or channel. An air stream is directed into an adjacent wet duct or channel having a common wall with the dry duct. In the wet duct, water is evaporated into the stream of air, cooling the common wall and consequently the air in the dry duct. Such methodology to cool is advantageous, because relatively little energy is required and no dangerous gases are required. A downside of indirect evaporative cooling is that the temperature to which such a system can cool the air down to is limited by the amount of moist in the ambient air. To reduce the amount of moist, an indirect evaporative cooling unit can be combined with an air drying device. An air treatment system for a building including a central air handling unit comprising a drying device for the dehumidification of air coming from outside of the building and an indirect evaporative cooling unit for cooling the dehumidified air is known, see for example U.S. Pat. No. 6,018,953.

Disadvantages of such known systems are that relatively large conduits are required to transport the cooled dry air to the various spaces of a building in order to sufficiently cool said spaces, the air handling unit containing this system is relatively large, and control of the air condition of individual spaces of a building is limited and difficult.

The aim of the present invention is to provide a building comprising an air treatment system which at least partly overcomes these above described disadvantages.

This aim is achieved by the following building. Building comprising more than one separate spaces and an air treatment system, wherein the air treatment system comprises a central air drying unit fluidly connected by a network of connecting conduits to two or more local evaporative cooling units, wherein at least two local evaporative cooling units are each fluidly connected to a separate space of the building and wherein the local evaporative cooling unit comprises one or more cooling channels provided with an inlet and an outlet for air and one or more evaporating channels provided with an inlet and outlet for air and wherein the cooling channels and evaporating channels are separated by a transfer wall and wherein the one or more evaporating channels are provided with means for wetting the transfer wall such that evaporation can take place in the evaporating channels and wherein the central air drying unit comprises an inlet for air obtained at the exterior of the building and an outlet for dried air which is fluidly connected to the local evaporative cooling units and wherein the outlet of the one or more cooling channels is fluidly connected to the interior of the separate space and the outlet of the evaporating channel is fluidly connected to the exterior of the separate space.

Applicant found that by centrally drying the air and locally cooling the air according to the invention the diameter of the conduits running through the building can be smaller than when using the prior art system and fewer conduits are required. A further advantage is that each local evaporative cooling unit can be independently operated according to the air condition requirements per separate space. Another advantage is that the central air handling unit can be smaller, because the central unit does not have to contain the evaporative cooling capacity contained in the local units. A next advantage is that by cooling locally, air extracted from one separate space cannot re-enter another separate space via the air treatment system. Further advantages shall be discussed when describing the preferred embodiments of the invention.

The building according to the invention comprises more than one separate spaces. By space is meant any space in the building defined by its walls, floor and ceiling. A space is separate from another space when air cannot readily move from one space to said other space and that the air in said separate space may be conditioned separately from the other space. In other words the spaces are not fluidly connected. Between such separate spaces doors and other closable openings may be present which allow temporally movement of air between the spaces.

The number of separate spaces is more than one. Suitably the advantages of the invention are more profound when more than 3, preferably more than 5 separate spaces are fluidly connected to more than 3, preferably more than 5 local evaporative cooling units. The maximum number of local evaporative cooling units which may suitably be fluidly connected to the outlet for dried air of one central air drying unit may be 30. For higher numbers of local evaporative cooling units and connected separate spaces one may choose to use more than one air treatment system. For example in a building having multiple levels and each level having multiple separate spaces one may choose to provide each level with an air treatment system comprising a central air drying unit fluidly connected to two or more local evaporative cooling units which in turn are connected to the separate spaces on that level.

A building may also be comprised of a number of separate buildings wherein the spaces of said separate buildings are fluidly connected to the local evaporative cooling units according to this invention. An example of such a building is a holiday camp comprised of separate buildings for guests.

One local evaporative unit can be fluidly connected to one or multiple separate spaces, wherein the one or more other local evaporative cooling units are fluidly connected to different separate spaces.

The outlet of the central air drying unit and the inlet of the local evaporative cooling units are fluidly interconnected by a network of connecting conduits. A network of connecting conduits may contain a variable amount of branches and each branch may contain a variable amount of local evaporative cooling units.

Suitably the local evaporative cooling unit is provided with means to vary and interrupt the throughput of dried air as drawn from the central air drying unit. Such means also interrupt the connection between said unit and the network of connecting conduits. Such means are advantageously used to interrupt the fluid connection between a single unit and this network in case this single unit does not draw in any dried air. In the absence of such a means to interrupt the fluid connection one local evaporative unit may then draw in air from a unit that does not draw in air instead of drawing in air from the central air drying unit. Such means to interrupt the fluid connection between the inlet of the local evaporative cooling unit and the network of connecting conduits may be a valve and more preferably a valve which throughput can be varied and interrupt and even more preferably wherein the throughput can be controlled.

The means for transporting the air from the central drying unit to the local evaporative cooling units can be a ventilator. This ventilator can be located centrally, whereby one ventilator provides the air transportation to more than one local evaporative cooling unit, whereby the amount of air transported to each local evaporative cooling unit can be controlled by adjusting the pressure drop of dried air over the local evaporative cooling unit.

The local evaporative cooling unit can be provided with either one or two ventilators and these ventilators can be combined with central ventilators at the central drying unit. The local ventilators may be positioned to either draw in air from the central unit, draw in air from the separate space and/or discharge moist air from the evaporation process to the exterior of the separate space. The moist air from the evaporation process can be either directly discharged from the separate space to the exterior of the building, or can be collected in a common network of conduits, where more than one local evaporative cooling units moist air is discharged to the exterior of the building. Another ventilator can also be positioned in this last network of conduits, to draw in and discharge moist air from more than one local evaporative cooling unit.

Suitably the local evaporative cooling unit is provided with a means to real-time measure the amount of dried air drawn from the central drying unit. Such a measurement may be used to adjust the throughput of the adjustable valve and/or the rotational speed and thus the capacity of the earlier referred to ventilator.

To measure the amount of dried air drawn from the central drying unit to a local unit and to be able to adjust this amount is advantageous because it allows to keep the volume flow of dried air to a local evaporative cooling unit constant at a desired volume and allows the adjustment of volume flow to the changing air condition requirements of the separate space. For example, a change in the volume of dried air drawn in by one unit, may affect the pressure in the network of connected conduits and thus the amount of dried air drawn in by one or more of the other units. By being able to measure and control the volumetric flow locally, the volume flow can be kept constant independent from other units. Also in a dynamic control of the unit the measurement of the volumetric flow is advantageous to better adjust the various settings of the unit.

Alternatively and additionally the local evaporative cooling unit may be provided with means to measure the volume of any other air stream to and from the local evaporative cooling unit. Such measurements can also be done by mobile temporary measuring devices and also can be applied either before or after the air treatment system is installed in the building. Such measurements can be used as input to control the air volume when the air treatment system is operational. Suitably, the local evaporative cooling unit is provided with a means to measure the amount of air taken from the interior of the separate space.

The local evaporative cooling unit comprises one or more cooling channels provided with an inlet and an outlet for air and one or more evaporating channels provided with an inlet and outlet for air. The cooling channels and evaporating channels are separated by a transfer wall to achieve indirect evaporative cooling. The evaporating channel is provided with means for wetting the transfer wall such that evaporation can take place in the evaporating channel. The heat for evaporation of the water will be extracted via the transfer wall from the air in the cooling channel. The layout of the cooling channels, evaporating channels and transfer walls may be such that a sufficient heat transfer is possible. Preferably the channels are so configured that a counter current flow is possible between the air in the cooling channels and the air in the evaporating channels. Examples of possible configurations are plate heat exchangers for example shown in US2004226698A, US2002073718A and US2011302946 (A1).

The manner of which the one or more cooling channels and one or more evaporating channels of a local evaporative cooling unit are fluidly connected to the outlet of the central air drying unit and to the separate space may vary and may be chosen based upon the air condition requirements of a separate space.

In a first possible local evaporative cooling unit the inlet of the cooling channels is fluidly connected to the outlet for dried air of the central air drying unit and the interior of the separate space and the outlet of the one or more cooling channels is fluidly connected to the interior of the separate space and fluidly connected to the inlet of the one or more evaporating channels. In this manner cooled air is supplied to the evaporating channels. Using an indirect evaporative cooling unit in such a way is called dew point cooling, because the indirect evaporative cooler is able to cool past the dry-bulb temperature and towards the dew point temperature of the cooled air. In such a first possible unit the inlet of one or more cooling channels is fluidly connected to the interior of the separate space and to the outlet for dried air of the central air drying unit. By circulating part of the air as drawn in from the interior of the separate space to the inlet of the cooling channels a significantly larger volume of air may be supplied to the cooling channels resulting in a larger cooling capacity of the local unit. The volume of air as drawn in from the interior of the separate space does not need to be drawn in from the central unit, allowing for smaller air ducts from the central unit to the local unit, as compared to a conventional system where all air is supplied from the central unit. Furthermore, as the volume of air as drawn in from the central unit is smaller in the present invention, less air has to be dehumidified by the central drying unit, thus allowing for a smaller capacity central drying unit. The air as drawn in from the interior of the space may even be colder than the dried air resulting in a more efficient cooling. Furthermore no air enters the separate space which has been extracted from another separate space. This is especially advantageous to avoid the undesirable spread of substances, such as diseases and odours, from one space to another.

In a second possible local evaporative cooling unit the inlet of the one or more evaporating channels is fluidly connected to the outlet for dried air of the central air drying unit and the inlet and outlet of the one or more cooling channels is fluidly connected with the interior of the separate space. In such a local evaporative cooling unit the air of the separate space is recirculated and no air from outside the separate space is supplied to said separate space. This may be advantageous in spaces which need to be kept sterile like in operating rooms of hospitals, laboratories and data centres.

In a third possible local evaporative cooling unit the inlet of the one or more cooling channels is fluidly connected to the outlet for dried air of the central air drying unit, the outlet of the one or more cooling channels is fluidly connected to the interior of the separate space and the inlet of the one or more evaporating channels is fluidly connected with the interior of the separate space. In this unit the air as present in the separate space is discharged via the evaporating channels from said space and replaced by the dried and cooled air as discharged from the unit into the separate space. This may be advantageous when the separate space requires only fresh ambient air.

When no cooling is required the above third possible unit may be advantageously used for supplying fresh ambient air to said separate space and discharging air from said separate space in a process of heat exchange, whereby the heat from the relatively warm indoor air is exchanged with relatively cold outdoor air. In this case the indoor air passes through the one or more evaporating channels, whereby the wetting means are turned off, i.e. there is no moisture added to the evaporating channel(s), and the fresh ambient air passes through the one or more cooling channels. In this case, dehumidification by the central drying unit does not need to take place.

When cooling is required and outside air temperature is low enough, any of the above units may be advantageously used for supplying fresh and relatively cool air to the separate space, without any evaporative cooling nor heat exchange taking place. The outside air can be transported directly to the separate space and the indoor air can be transported out of the separate space, where at least one of the air streams bypasses the cooling and evaporating channels.

Suitably any possible local evaporative cooling unit is provided with a ventilator suited to draw in dried air from the central air drying unit to the local evaporative cooling unit. This is advantageous because this allows omitting a ventilator at the central air drying unit. Another advantage is, that when each evaporative cooling unit has its own controls, these controls do not need to be connected to the central controls. Another advantage is that these local ventilators mostly draw in air, in stead of blowing out air as a central ventilator does. The flow of air drawn in is more uniform as opposed to air blown out, and this saves energy. Preferably the ventilator is a radial ventilator because the air discharged by the radial ventilator has a more equal distribution.

When any of the above local evaporative cooling units is provided with a ventilator suited to draw in dried air from the central air drying unit, and one or more local evaporative cooling units of the first possible kind are applied, the ventilator of these units suitably should be located such, that it draws in both air from the central drying unit and air from the inside of the separate space. Any of the above local evaporative cooling units may be provided with heating means to increase the temperate of the air as discharged into the separate space in a situation wherein heating is required instead of cooling.

The separate spaces of the building may be fluidly connected to one of the above possible evaporative cooling units. The local evaporative cooling units as part of the air treatment system may be of one single type or may be comprised of at least two of the evaporative cooling units described above. Preferably the above described first possible evaporative cooling unit is comprised in an air treatment system. The evaporative cooling unit may be provided with means to modify the unit from one type described above to a different type as described above. These means may comprise valves and connecting conduits which one skilled in the art will readily understand to apply for this use.

Two local evaporative cooling units as part of an air treatment system, which may or may not be of the same type, may perform different functions at the same time separate from each other and may separately from each other change function over time, or may separately from each other be turned off.

Suitably the air treatment system is controlled by a controller. The central drying unit will have a controller. Each individual evaporative cooling unit may or may not have its own controller. When an individual evaporative cooling unit has its individual controller, this controller may or may not be connected to a central controller. The advantage of a local evaporative cooling unit to have its own controller, is that less wiring and programming is required, because there is none or less connection with the central controller required.

Suitably the separate space has a measuring means which measures at least one relevant aspects of the air condition in the room, for example the temperature level, the humidity level and/or the CO2 level. The controls may use these measurements to determine which functionality and capacity the related local evaporative cooling unit will perform.

Alternatively other input may be used in either a centrally positioned or locally positioned controller to determine which functionality and capacity the local evaporative cooling unit will perform, such as for example a time measurement and general outside weather conditions such as temperature and humidity.

Suitably the controlling means allow for a local evaporative cooling unit to adjust its cooling capacity to the required cooling capacity of the separate space. The cooling capacity of the local evaporative cooling unit can be adjusted in a variety of methods. For example by adjusting the amount of moist added in the evaporating channel. Another method is to adjust the total volume of air used in both the cooling channel and the evaporating channel. Yet another method is to adjust the ratio of volume of the air in the cooling channel in relation to the air in the evaporating channel.

The air supplied to the central drying unit and/or as discharged as dried air may be cooled before being supplied to the local evaporative cooling units. The lower temperature thus provided to the local evaporative cooling units may be advantageous because either the same local evaporative cooling units can provide an even lower temperature, and/or less air can be transported to the local evaporative cooling units to provide the same cooling capacity, allowing for smaller local evaporative cooling units and smaller diameter tubing for transporting the dried and partially cooled air to said local units. Such cooling may be performed in any manner suited to lower the temperature of this stream of air. Preferably the cooling unit is an evaporative cooling unit. The central drying unit is thus suitably fluidly connected to a central evaporative cooling unit located such to cool the air provided to the central drying unit and/or to the air discharged from the central drying unit and wherein the central evaporative cooling unit located to cool air discharged from the central drying unit is provided with an outlet for dried and cooled air fluidly connected to the two or more local evaporative cooling units. Alternatively, the dried air discharged from the central drying unit may be cooled by use of an heat exchanger, in which the heat from the dried air is in the heat exchanger transferred to a second air stream, which is relatively colder than the dried air discharged from the drying unit. This second air stream can for example be ambient air. This second air stream may after having exchanged heat in the heat exchanger be used as air to regenerate the air dryer.

The central drying unit can be designed as an air handling unit comprising additional process units like the above described cooling unit, for example air filters and/or heaters, and/or moistening means and/or heat exchanger may be present.

The drying capacity of the central drying unit is suitably adjustable to the required capacity of the local evaporative cooling units fluidly connected to the central drying unit. This will allow the central drying unit to deliver the required capacity and not more, thus saving energy used in the drying process. The required capacity of the central air drying unit can be determined in a variety of ways. For example by calculating the required capacity based on feedback from the local units, such as the amount of units active and the functions they perform or by local measurements of the indoor air condition such as temperature and humidity and the degree to which the required conditions are met. Another example of determining the required capacity of the central drying unit is by measuring the humidity level before and/or after the drying unit, or measuring the airflow through the drying unit.

The drying capacity of the central drying unit can be adjusted in a variety of ways, for example by adjusting the amount of heat added to the regeneration process of the drying unit or by changing the amount of active centrally positioned drying material. In this manner it is possible to add or take off line parts of the drying unit depending on the required capacity.

The drying unit may be any unit which can lower the amount of water in air. This may be achieved by cooling the air and separating the condensed water from the cooled air. Preferably the central drying unit makes use of a sorption material which when is capable of absorbing water from the air. The thus loaded sorption material is then regenerated and re-used to dry air.

Suitably a sorption material with a low regeneration temperature is present in the central air drying unit. Preferably the sorption material is a polymer with a lower critical solution temperature (LCST polymer). Such a LCST polymer may be chosen from the group comprising polyoxazoline, poly(dimethylamino ethyl methacrylaat) (pDMAEMa) and poly(N-isopropylacrylamide) (pNiPAAm). Such drying methods and sorption materials are known and for example described in WO2007024132 and WO11142672.

Alternative to a central drying unit included in the air treatment system, the central drying unit can also be a central cooling unit, for example an indirect evaporative cooling unit. When the ambient climate of the building in which the air treatment system is included does not require dehumidification for indirect evaporative cooling to function properly, the present invention's advantages can be used, without using a central drying unit.

The invention is also directed to the following method. Method to cool the air in two or more separate spaces by (a) drying ambient air in a central air drying unit to obtain a volume of dried air, (b) transporting a part of the volume of dried air as obtained in step (a) to each separate space and (c) using the dried air in a process of indirect evaporative cooling to obtain cooled air which is discharged into the interior of the separate space.

(d) discharging the moist air from the process of indirect evaporative cooling to the exterior of the separate space.

In the above process ambient air is air extracted from the exterior of the separate spaces. The separate spaces may be part of one construction or part of more than one construction.

The indirect evaporative cooling in step (c) may be performed for one separate space by one of the following methods 1-3 and wherein step (c) for another separate space may be performed by the same method or by any of the two other methods 1-3:

method 1 to obtain the cooled air by indirect heat exchange of a mixture of the dried air and air drawn in from the interior of the separate space against a stream of evaporating water in part of the cooled air;

method 2 to obtain cooled air by indirect heat exchange of air drawn in from the interior of the separate space against a stream of evaporating water in the dried air.

method 3 to obtain cooled air by indirect heat exchange of the dried air against a stream of evaporating water in air drawn in from the interior of the separate space;

In step (b) a central means to transport air may be used to let the dried air flow to the individual separate spaces. Preferably the required part of the volume of dried air may be drawn in by means of a ventilator. Such a ventilator will be present at the receiving end of the dried air, i.e. near the separate space. The capacity of the ventilator to draw in dried air for one space may be varied independently from the capacity of a ventilator to draw in dried air for a separate space. In this manner the conditions, i.e. temperature, in the separate spaces may be adjusted independently from each other.

The amount of dried air as drawn in in step (b) is suitably controlled by (i) measuring the amount of air drawn in in step (b) to each separate space, (ii) determining the required amount of air to be drawn in in step (b) to each separate space and (iii) adjusting the amount of air drawn in in step (b), based on the measurement obtained in step (i) and the required amount of air by the process (ii) by adjusting the capacity of the ventilator and/or by adjusting a throughput restriction means (valve) positioned in the flow path of the dried air as drawn in in step (b). In case of a central means to create transportation of air the adjustment of the restriction means may be used to adjust the amount of air as drawn in to each separate space. In case that a local ventilator is used such adjustment may be performed by adjusting the capacity of the ventilator and preferably in combination with adjusting the throughput restriction means.

Suitably the drying capacity of the drying unit is adjusted when the required capacity of dried air as required to condition the two or more separate spaces changes. This is advantageous because the air dryer then does not use more energy for drying than required.

Preferably the above method is performed in the above described building according to the invention.

The invention will be further illustrated by the following figures.

FIG. 1 shows a state of the building with an air treatment system according to a scheme of U.S. Pat. No. 6,018,953.

Figure 5:
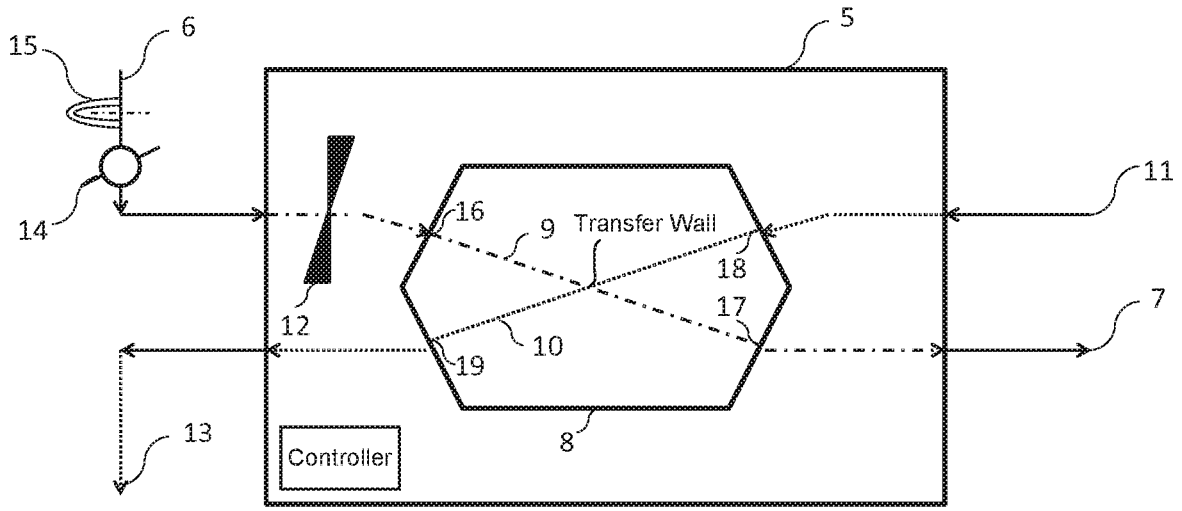
Figure 6A:
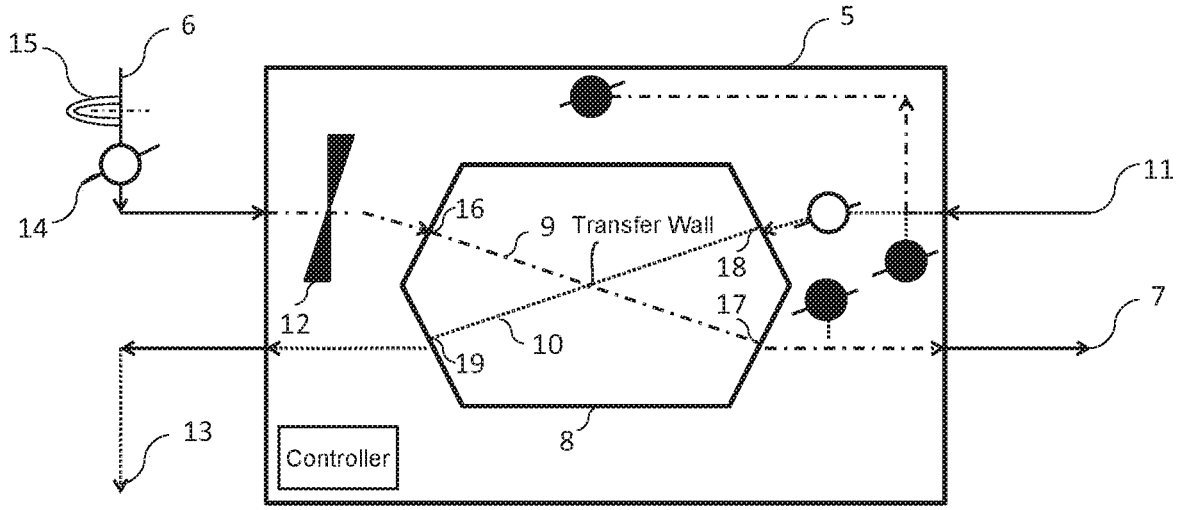
Figure 6B:
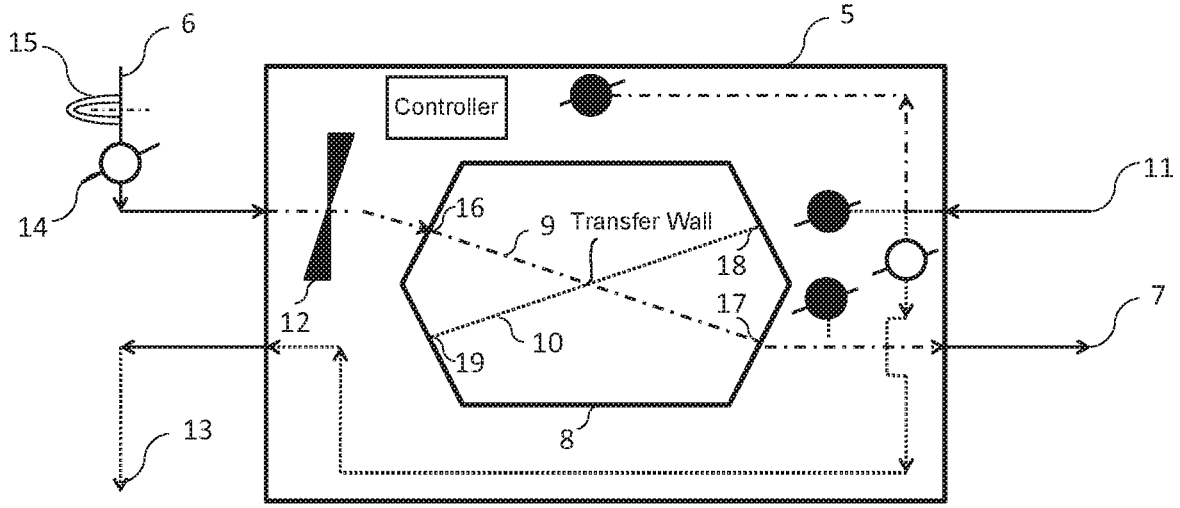

FIG. 5 shows a flow diagram of a local indirect evaporative cooling unit according to a third possible local unit of the invention; and FIGS. 6A and 6B show a flow diagram of a local indirect evaporative cooling unit according to a first possible local unit of the invention, wherein FIG. 6A shows the system for heat recovery and FIG. 6B shows the system for bypassing the heat exchanger. In the figures alike elements are indicated with alike reference number.

Figure 1:
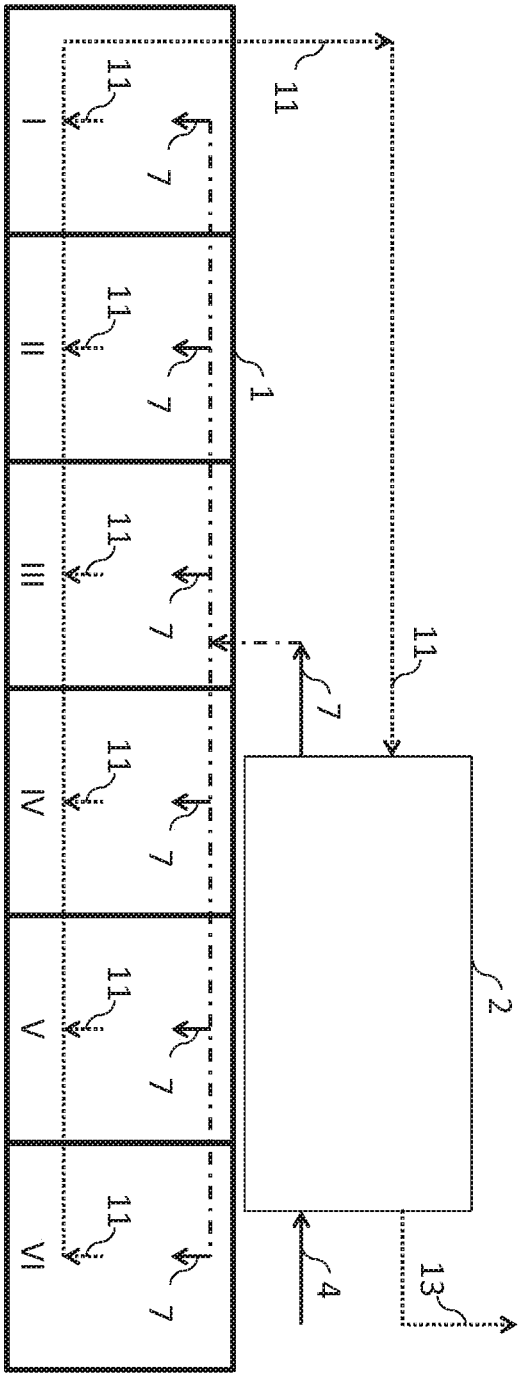

FIG. 1 shows a state of the building 1 wherein cool air is provided to separate spaces I, II, III, IV, V and VI according to the conventional method such as described for example in U.S. Pat. No. 6,018,953. In this figure a combined air drying unit and indirect evaporative cooling unit is shown as combined unit 2. From this combined unit 2 cooled supply air 7 is provided via dedicated conduits to each separate space I, II, III, IV, V and VI. From each separate space I, II, III, IV, V and VI the same amount of supply air 7 is returned to the combined unit 2 via a central conduit. It is clear that in the system of FIG. 1 air extracted from one space may recycle via unit 2 to another space.

Figure 2:
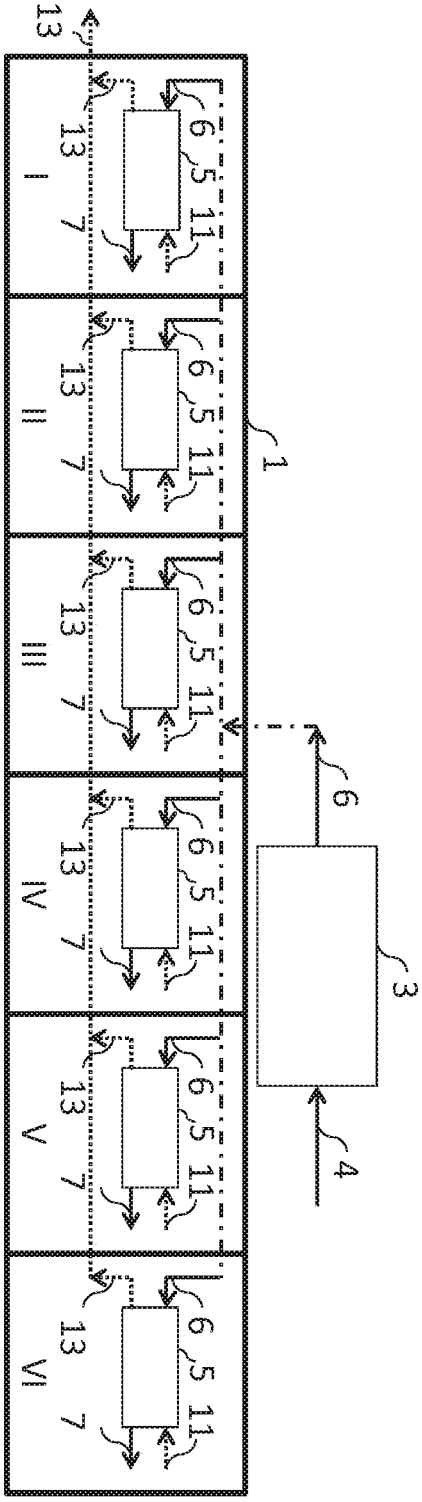
FIG. 2 shows a similar state of the building with an air treatment system according to the invention.

In FIG. 2 a similar building 1 as in FIG. 1 is shown having the same separate spaces I, II, III, IV, V and VI. A difference with FIG. 1 is that the air drying unit and indirect evaporative cooling unit are separated so that the air treatment system comprises a central air drying unit 3 fluidly connected to multiple local indirect evaporative cooling units 5, wherein at least each indirect evaporative cooling unit 5 is fluidly connected to a separate space of the building 1 and wherein the air drying unit 3 comprises an inlet 4 for air obtained at the exterior of the building and an outlet 6 for dried air which is fluidly connected to the local indirect evaporative cooling units 5 and wherein the outlet of the one or more cooling channels is fluidly connected to the interior of the separate spaces I, II, III, IV, V and VI and the outlet of the one or more evaporating channels is fluidly connected to the exterior of the separate space 13. The average distance between central air drying unit 3 and local indirect evaporative cooling unit 5 in terms of the length of the conduit may be more than 5 and preferably more than 10 meters and may even be up to 50 meters. In this case the central air drying unit 3 is positioned on the roof of the building 1. Alternatively the central air drying unit 3 can be positioned inside the building 1. In the central air drying unit 3 different devices can be positioned, among which in each case a drying unit for the dehumidification of air coming from outside of the building. For example a ventilator (not shown) can be provided for the intake of fresh outside air 4. After dehumidification, the fresh outside air is directed to a number, in this case six, of locally in the building in various spaces I, II, III, IV, V and VI positioned local indirect evaporative cooling units 5, which air streams are indicated with arrows 6. It is noted that in FIG. 2 one local indirect evaporative cooling unit 5 per space is positioned. The six local indirect evaporative cooling units 5 are each connected in parallel to each other to the central drying unit 3, wherein the airstream from the central drying unit 3 is distributed as desired among the indirect evaporative cooling units 5. For this a number of air ducts can be provided which connect the local indirect evaporative cooling unit 5 to the separate spaces I, II, III, IV, V and VI. It is evident that the system according to the invention in this way can be designed flexibly as desired. In FIG. 1 the local evaporative cooling units 5 are shown to be positioned inside the separate space. Alternatively, any of the local evaporative cooling units 5 can be positioned to the exterior of the separate space, as long as the outlet of the one or more cooling channels is fluidly connected to the interior of the separate space.

Figure 3:
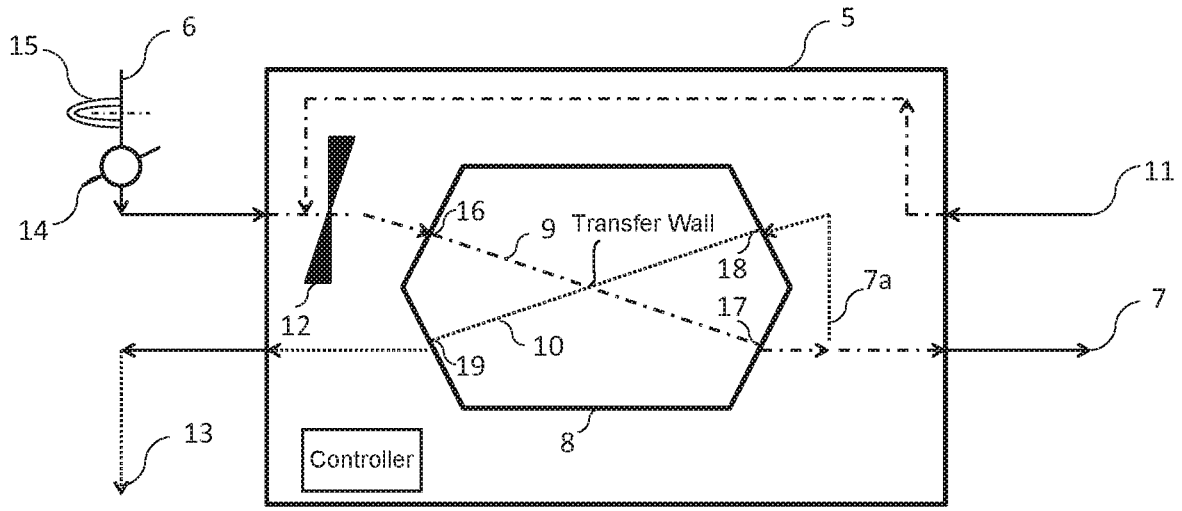
FIG. 3 shows a flow diagram of a local indirect evaporative cooling unit according to a first possible local unit of the invention.

FIG. 3 shows a flow diagram of the above referred to first possible local evaporative cooling unit 5, wherein the local indirect evaporative cooling unit 5 comprises a heat exchanger 8 with one or more cooling channels 9 provided with an inlet 16 and an outlet 17 for air and one or more evaporating channels 10 provided with an inlet 18 and outlet 19 for air. Not shown in this figure is that the cooling channels 9 and evaporating channels 10 are separated by a transfer wall and wherein the one or more evaporating channels 10 is provided with means for wetting the transfer wall such that evaporation can take place in the evaporating channels 10. The cooling channels 9 and evaporating channels 10 in heat exchanger 8 can for example be constructed as described in US2004226698A, US2002073718A and US2011302946 (A1) or any alternative method in which channels are constructed in a heat exchanger and/or indirect evaporative cooler. Further shown is a ventilator 12 to draw in dried air from the central air drying unit 3. In this conduit 6 a valve 14 is present which can be modulated to partly or completely cut off the fluid connection between the interior of the separate space and the network of connecting conduits. To completely cut off the fluid connection is advantageous in case the separate space does not require cooling and the other spaces do require cooling. If such a cut off is not possible the ventilators of the other units 5 of the other spaces would draw in air from the not active unit and its fluidly connected space, in stead of from the central drying unit 3. FIG. 3 further shows a means 15 to measure the flow of air in conduit 6. This information may be used to control valve 14 and ventilator 12. Also a reheater (not shown) can be present in the supply airstream to increase the temperature of the air in a situation wherein heating is required instead of cooling.

In the local indirect evaporative cooling unit 5 the outlet of the one or more cooling channels 17 is fluidly connected to the interior of the separate space via conduit 7 and fluidly connected to the inlet of the one or more evaporating channels 18 via conduit 7*a*. The inlet of one or more cooling channels 16 is fluidly connected to the interior of the separate space via conduit 11. The inlet of one or more cooling channels 16 is also fluidly connected to the outlet for dried air 6 of the central air drying unit 3. The outlet of the evaporating channels 19 is connected to conduit 13. The evaporating channels 10 are provided with means for wetting the transfer wall such that evaporation can take place in the evaporating channel. It is noted that the ventilator 12 and valve 14 can be positioned locally at any suitable location fluidly connected to the dried airstream. Alternatively any configuration can be used of either a central ventilator and/or a locally positioned ventilator(s) to create the same design of air flow. It is also noted that the ventilator 12, valve 14 and means to measure the flow of dried air 15 can all or any of them be positioned in a common housing with heat exchanger 8 or be positioned in housing separate from heat exchanger 8.

Figure 4:
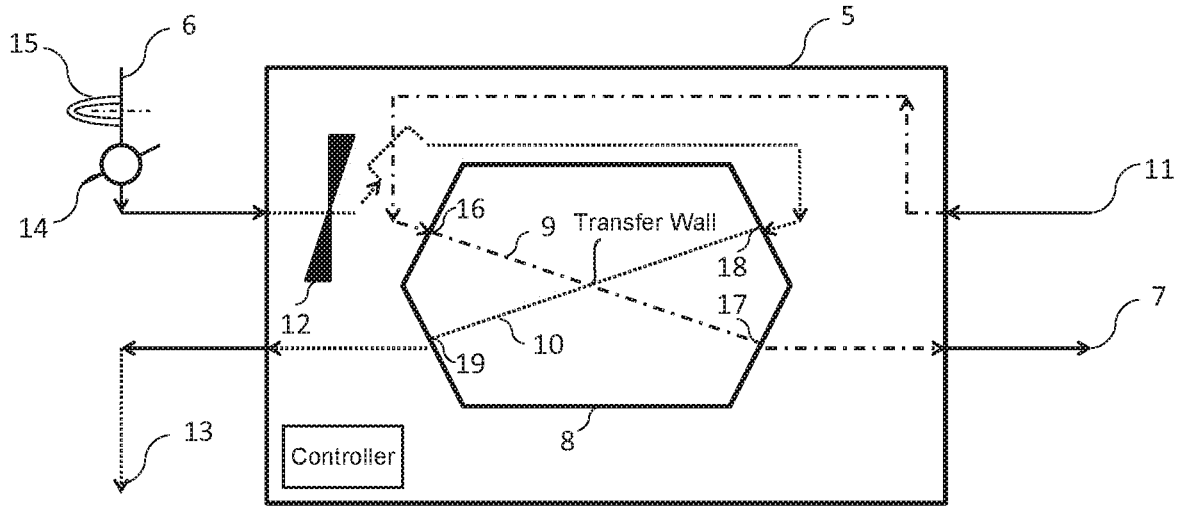
FIG. 4 shows a flow diagram of a local indirect evaporative cooling unit according to a second possible local unit of the invention.

FIG. 4 shows a flow diagram of the above referred to second possible local unit 5, using the same elements 6-19 as in FIG. 3. In the local indirect evaporative unit the inlet 18 of the one or more evaporating channels 10 is fluidly connected to the supply of dried air of the central air drying unit 3 via conduit 6. The inlet 16 and outlet 17 of the one or more cooling channels 9 is fluidly connected with the interior of the separate space via conduits 11 and 7.

FIG. 5 shows a flow diagram of the above referred to third possible local unit 5, using the same elements 6-19 as in FIG. 3. In the local indirect evaporative unit the inlet 16 of the one or more cooling channels 9 is fluidly connected to the outlet for dried air 6 of the central air drying unit 3. The outlet 17 of the one or more cooling channels 9 is fluidly connected to the interior of the separate space via conduit 7. The outlet 19 of the one or more evaporating channels 10 is fluidly connected with the interior of the separate space via conduit 13.

FIG. 6A shows how a unit according to FIG. 3 may be amended for a situation wherein no cooling is required. The local unit can then be advantageously used for supplying fresh air to said separate space and discharging air from said separate space wherein heat recovery between the relatively warm indoor air and the relatively cold outdoor air is achieved. This is achieved by passing the indoor air through the one or more evaporating channels 10, whereby the wetting means are turned off. The outside air passes through the one or more cooling channels 9. The black circles are the closed valves to close conduit 7*a*, the direct connection to the inlet 16 and to the direct connection to conduit 13 as shown in FIG. 6B. Dehumidification by the central drying unit does not need to take place. In this case, a ventilator 12 is required to draw in the air from conduit 6 and through the one or more cooling channels 9.

FIG. 6B shows how a unit according to FIG. 3 may be amended for a situation wherein cooling is required and outside air temperature is low enough to achieve said cooling. The figure shows a situation wherein no heat exchange takes place. The air drawn in by ventilator 12 from conduit 6 and via cooling channels 9 to conduit 7 is not exchanged in heat in said unit. This because the air drawn in from the interior of the space via conduit 11 is directly connected to the conduit 13 and bypasses the evaporating channels 10.

To illustrate the advantages of the present invention a comparison is made between a state of the art building according to FIG. 1 and a building according to the invention as in FIG. 2. The local indirect evaporative cooling units for FIG. 2 are according to the first possible local unit of the invention according to FIG. 3.

In this example, a cooled supply air flow of 4.200 $m^3$/h to condition the building is assumed for both systems. Also an extract/exhaust air amount of 4.200 $m^3$/h to the exterior of the building is assumed, since it is common in air treatments systems to both supply and extract at least a similar amount of air to and from the building. Air is supplied to each separate space (in case of the system from FIG. 1) or local evaporative cooling unit (in case of the system from FIG. 2) through a common air duct from the central unit to the local spaces/units. The example assumes six separate spaces, each with equal cooled supply air and exhaust air to the exterior of 700 $m^3$/h. In this example the local evaporative cooling units of FIG. 2 are position in the separate spaces.

In a building according to FIG. 1, the central unit will have to transport 4.200 $m^3$/h both to and from the building and 700 $m^3$/h both to and from each separate space, with size of the conduits matching these numbers.

In a building according to FIG. 2, the central drying unit will have to transport 1800 $m^3$/h to the building and 300 $m^3$/h to the local evaporative cooling units to achieve the same cooled air supply to each unit. This shows that smaller conduits may be used for building according to the invention. Because the air in FIG. 2 is not yet cooled insulation may in certain climate situations even be omitted.

Each local evaporative cooling unit will draw in 700 $m^3$/h from the interior of the separate space and supply this together with the 300 $m^3$/h from the central drying unit to the inlet of the cooling channels. A total of 1.000 $m^3$/h exits the outlet of the cooling channels, from which 700 $m^3$/h is supplied to the interior of the separate space and 300 $m^3$/h is discharged to the exterior of the separate space and the building which may be via a relatively short conduit.

The table below gives an overview of the required air ducts per building. From this table it is clear the less air ducts are required for the present invention. It is also clear that less air needs to be dehumidified in a building according to the present invention, being at least 4200 $m^3$/h for the conventional system and 1800 $m^3$/h for the present invention.

| | Amount of air for which air ducts are required ($m^3$/h) | |
|---|---|---|
| Location of the air ducts | Building according to FIG. 1 | Building according to FIG. 2 |
| From the central unit to the building | 4200 | 1800 |
| From the common air duct to the separate space or local unit | 700 | 300 |
| From the building to the central unit | 4200 | 0 |
| From the separate space or local unit to the common air duct | 700 | 0 |
| From the local unit to the exterior of the building | 0 | 300 |

The invention claimed is:

1. Building comprising more than one separate spaces and an air treatment system, wherein the air treatment system comprises a central air drying unit fluidly connected by a network of connecting conduits to two or more local evaporative cooling units, wherein at least two local evaporative cooling units are each fluidly connected to a separate space of the building and wherein the local evaporative cooling unit comprises one or more cooling channels provided with an inlet and an outlet for air and one or more evaporating channels provided with an inlet and outlet for air and wherein the cooling channels and evaporating channels are separated by a transfer wall and the transfer wall is wet such that evaporation can take place in the evaporating channel and wherein the central air drying unit comprises an inlet for air obtained at the exterior of the building and an outlet for dried air which is fluidly connected to the local evaporative cooling units and wherein the outlet of the one or more cooling channels is fluidly connected to the interior of the separate space and the outlet of the one or more evaporating channels is fluidly connected to the exterior of the separate space.

2. Building according to claim 1, wherein the local evaporative cooling unit is provided with a control valve to vary and interrupt the throughput of dried air as drawn from the central air drying unit.

3. Building according to any one of claims 1-2, wherein the amount of dried air drawn from the central drying unit to said local evaporative cooling unit is measured.

4. Building according to claim 1, wherein the evaporative cooling unit is fluidly connected to the separate space of the building wherein the outlet of the one or more cooling channels is fluidly connected to the interior of the separate space and fluidly connected to the inlet of the one or more evaporating channels and wherein the inlet of one or more cooling channels is fluidly connected to the interior of the separate space and to the outlet for dried air of the central air drying unit.

5. Building according to claim 1, wherein the evaporative cooling unit is fluidly connected to the separate space of the building wherein the inlet of the one or more evaporating channels is fluidly connected to the outlet for dried air of the central air drying unit and the inlet and outlet of the one or more cooling channels are fluidly connected with the interior of the separate space.

6. Building according to claim 1, wherein the evaporative cooling unit is fluidly connected to the separate space such that the inlet of the one or more cooling channels is fluidly connected to the outlet for dried air of the central air drying unit, the outlet of the one or more cooling channels is fluidly connected to the interior of the separate space and the inlet of the one or more evaporating channels is fluidly connected with the interior of the separate space.

7. Building according to claim 1, wherein the local evaporative cooling unit is provided with a ventilator suited to draw in dried air from the central drying unit.

8. Building according to claim 1, wherein the amount of air drawn from the interior of the separate space to said local evaporative cooling unit is measured.

9. Building according to claim 1, wherein the cooling capacity of each evaporative cooling unit is controlled independently from one another.

10. Building according to claim 1, wherein the central drying unit is fluidly connected to a central evaporative cooling unit located such to cool the air provided to the central drying unit and/or to the air discharged from the central drying unit and wherein the central evaporative cooling unit located to cool air discharged from the central drying unit is provided with an outlet for dried and cooled air fluidly connected to the two or more local evaporative cooling units.

11. Building according to claim 1, wherein the drying capacity of the central drying unit is adjustable to the required capacity of the local evaporative cooling units fluidly connected to the central drying unit.

12. Building according to claim 1, wherein the central drying unit comprises a sorption material with a low regeneration temperature.

13. Building according to claim 12, wherein the sorption material is a polymer with a lower critical solution temperature (LCST polymer).

14. Building according to claim 13, wherein the LCST polymer is chosen from the group comprising polyoxazoline, poly(dimethylamino ethyl methacrylaat) and poly(N-isopropylacrylamide).

15. Method to cool the air in two or more separate spaces by (a) drying ambient air in a central air drying unit to obtain a volume of dried air, (b) transporting a part of the volume of dried air as obtained in step (a) to each separate and (c) using the dried air in a process of indirect evaporative cooling to obtain cooled air which is discharged into the interior of the separate space, (d) discharging the moist air from the process of indirect evaporative cooling to the exterior of the separate space.

16. Method according to claim 15, wherein step (c) is performed for one separate space by one of the following methods 1-3 and wherein step (c) for another separate space may be performed by the same method or by any of the two other methods 1-3:

method 1 to obtain the cooled air by indirect heat exchange of a mixture of dried air and air drawn in from the interior of the separate space against a stream of evaporating water in part of the cooled air;

method 2 to obtain cooled air by indirect heat exchange of air drawn in from the interior of the separate space against a stream of evaporating water in the dried air, method 3 to obtain cooled air by indirect heat exchange of the dried air against a stream of evaporating water in air drawn in from the interior of the separate space.

17. Method according to any one of claims 15-16, wherein in step (b) the required part of the volume of dried air is drawn in by means of a ventilator and wherein the capacity of the ventilator to draw in dried air for one space may be varied independently from the capacity of a ventilator to draw in dried air for a separate space.

18. Method according to any one of claims 15-16, wherein the amount of dried air as drawn in in step (b) is controlled by (i) measuring the amount of air drawn in in step (b) to each separate space, (ii) determining the required amount of air to be drawn in in step (b) to each separate space and (iii) adjusting the amount of air drawn in in step (b), based on the measurement obtained in step (i) and the required amount of air by the process (ii) by adjusting the capacity of the ventilator and/or by adjusting a throughput restriction means (valve) positioned in the flow path of the dried air as drawn in in step (b).

19. Method according to any one of claims 15-16, wherein the drying capacity of the drying unit is adjusted when the degree of dried air as required to cool the two or more separate spaces changes.

20. Building comprising more than one separate spaces and an air treatment system, the air treatment system comprising a central air drying unit fluidly connected by a network of connecting conduits to two or more local evaporative cooling units, wherein at least two local evaporative cooling units are each fluidly connected to a separate space of the building, each local evaporative cooling unit comprising one or more cooling channels with a first inlet and a first outlet and one or more evaporating channels with a second inlet and a second outlet, wherein the central air drying unit comprises a third inlet for air obtained at the exterior of the building and a third outlet for dried air which is fluidly connected to the local evaporative cooling units and wherein the first outlet of the one or more cooling channels is fluidly connected to the interior of the separate space and the second outlet of the one or more evaporating channels is fluidly connected to the exterior of the separate space.

* * * * *